United States Patent [19]

Villa et al.

[11] 4,186,676

[45] Feb. 5, 1980

[54] APPARATUS FOR FORMING A CHAIN OF STITCHES ON DOUBLE NEEDLE SEWING MACHINES

[75] Inventors: Enrico Villa; Angelo Radice, both of Milan, Italy

[73] Assignee: Rockwell-Rimoldi, S.p.A., Milan, Italy

[21] Appl. No.: 892,572

[22] Filed: Apr. 3, 1978

[30] Foreign Application Priority Data

Apr. 28, 1977 [IT] Italy ..... 22905 A/77

[51] Int. Cl.[2] ..... D05B 1/10 ; D05B 27/04; D05B 47/04

[52] U.S. Cl. ..... 112/165; 112/235; 112/254

[58] Field of Search ..... 112/163, 165, 235, 255, 112/254

[56] References Cited

U.S. PATENT DOCUMENTS

| | | | |
|---|---|---|---|
| 262,160 | 8/1882 | Wardwell, Jr. | 112/255 X |
| 1,124,320 | 1/1915 | Molyneux et al. | 112/235 X |
| 1,326,659 | 12/1919 | Hagelstein | 112/255 X |
| 1,589,629 | 6/1926 | Connors | 112/255 X |
| 1,765,342 | 6/1930 | Lutz | 112/235 X |
| 1,890,075 | 12/1932 | Card | 112/235 X |
| 2,434,158 | 1/1948 | Herr | 112/235 X |
| 2,582,211 | 1/1952 | Turner | 112/254 |
| 2,973,730 | 3/1961 | Schweda et al. | 112/165 X |
| 2,993,456 | 7/1961 | Herbst | 112/254 |
| 3,490,403 | 1/1970 | Boucraut | 112/254 X |
| 3,656,443 | 4/1972 | Ross | 112/235 X |

FOREIGN PATENT DOCUMENTS

| | | | |
|---|---|---|---|
| 292872 | 6/1928 | United Kingdom | 112/165 |
| 310959 | 10/1971 | U.S.S.R. | 112/255 |

*Primary Examiner*—Wm. Carter Reynolds

[57] ABSTRACT

A method and apparatus for forming a continuous chain of stitches between pieces of material on a double needle sewing machine which includes a sensing device for detecting the presence of material in the sewing area and connected to the sensing device elements are provided for releasing the tension on one of the needle threads upon indication of absence of material in the sewing area. Additionally an auxiliary feed device functioning in cooperation with the machine's feed dog and needle plate is effective in simultaneously advancing the untensioned needle thread with the single chain of stitches being formed.

1 Claim, 4 Drawing Figures

APPARATUS FOR FORMING A CHAIN OF STITCHES ON DOUBLE NEEDLE SEWING MACHINES

BACKGROUND OF THE INVENTION

The present invention pertains to a method and apparatus for forming a continuous chain of stitches between pieces of material on a sewing machine having two needles and a single looper located beneath the needle plate.

In sewing machines of this type the distance between the needles can vary, as is well known, in accordance with the particular stitching operation for which a machine is intended and the distance may vary as much as, or even exceed 6 millimeters.

More precisely, when the distance between needles is around 4 millimeters, it is not possible to form a continuous chain of stitches between pieces of material due to the threads of the needles having too great a distance between them in relation to the tension to which they are subjected by the looper thread, and because the needle plate in this type of machine has needle holes that extend in the direction of movement of the material and are located directly in the path of the teeth of the feed dog.

Consequently, when the stitches are no longer formed on the material, the traction action of the looper and the feed dog ceases on the threads of the needles. This traction action provides the required means for the correct linking of the threads beneath the needle plate. It is considered advantageous to form a chain of stitches between pieces of material sewn on the automatic machines described above without intervention of an operator even when the distance between the needles exceeds 4 millimeters so as to eliminate the necessity of pulling the threads manually to effect the linking together thereof.

Additionally, with no means for effecting a continuous chain of stitches between pieces of material, the conventional chain cutting devices cannot be utilized for cutting the seam threads adjacent the front and rear edges of the material and requires this severing operation to be performed manually in successive stages.

The method of forming a continuous chain of stitches according to the invention can be accomplished automatically in sewing machines having two needles regardless of the distance therebetween and with a single looper beneath the needle plate. The method also permits utilization of conventional chain cutting devices and reduces the number of additional handling and finishing operations that must be performed on the sewn material.

By means of this method, the tension on the thread of one of the needles is released when a stitched piece of material is advanced beyond the sewing area and this thread is maintained adjacent the tensioned thread of the other needle beneath the needle plate of the machine. This is effected by the relative movement, one toward the other, of the tensioned thread of the other needle and of the looper which remain unchanged so as to form a single chain of stitches.

The apparatus for accomplishing the method described above includes a device for releasing the tension of the thread of one of the needles which is operatively connected to a sensing means that is actuated by the lack of material in the sewing area. An element is also provided that forms an integral part of the needle plate and which extends transversely to the path of travel of the chain of stitches and serves to support said chain.

Additionally, the apparatus includes an auxiliary feed member that is supported by the machine's pressor foot and cooperates with the above needle plate element and feed dog, in the performance of its intended function to effect forward movement of the chain of stitches.

These and other features of the invention will become more fully apparent by reference to the appended claims and as the following detailed description proceeds in reference to the figures of drawing wherein:

DESCRIPTION OF THE PREFERRED EMBODIMENT

Figures 1, 2:
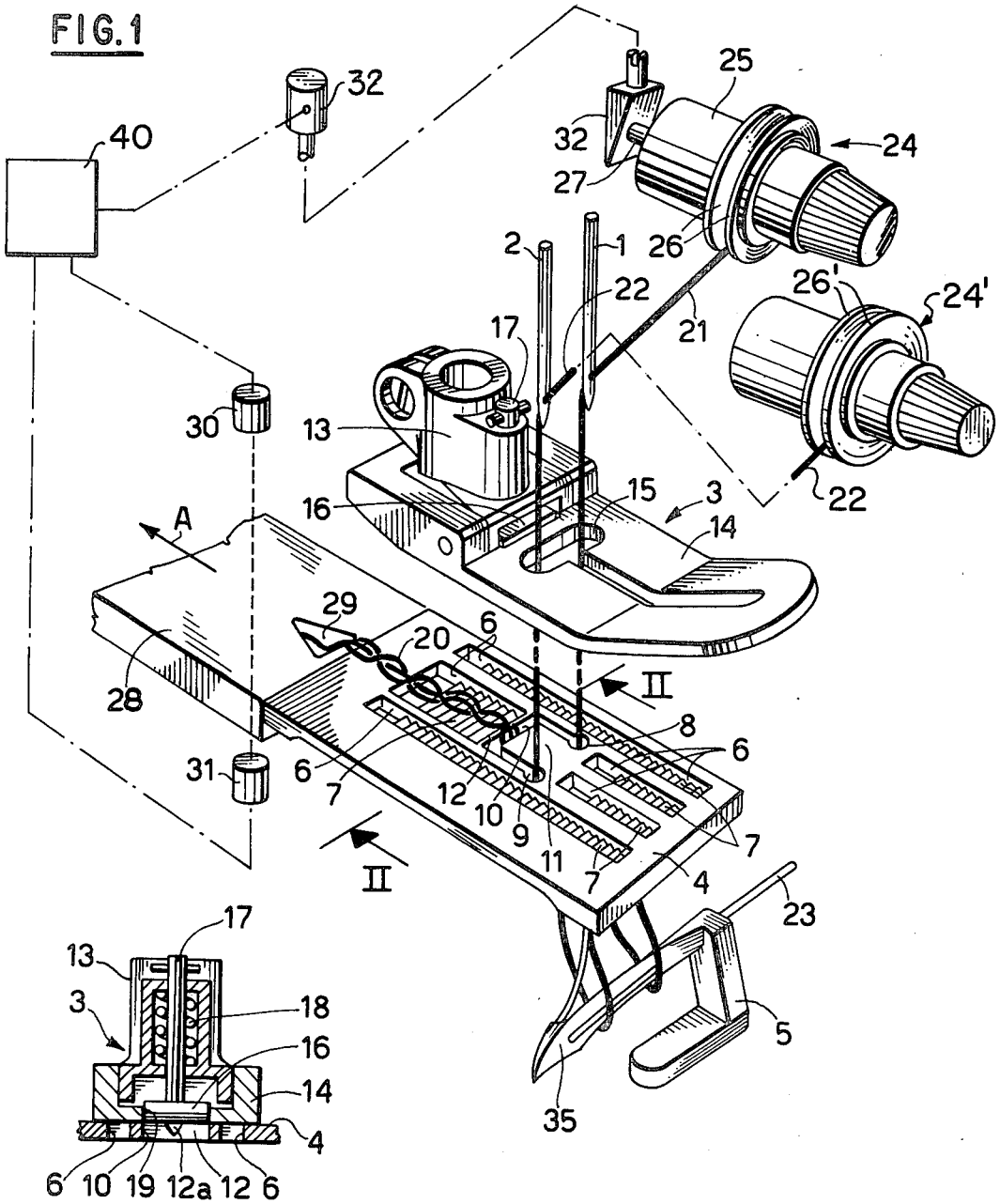
FIG. 1 is a perspective view in exploded form showing the elements of the apparatus for effecting the intended function of the invention.
FIG. 2 is a sectional view as seen looking in the direction of the indicating arrows of line II—II in FIG. 1.

Referring now to FIG. 1 the method in accordance with the present invention can be accomplished by a sewing machine having a pair of spaced stitching needles and a single looper. The machine is adapted to form two spaced parallel series of chain stitches due to the operating position of the needle threads which are caused to be linked with the single looper thread.

Such a seam is commonly known as number 406 in the U. S. Federal Sewing Catalogue, number 751.

As the general construction and operation of a sewing machine to which the present invention is applicable is well known and familiar to those conversant in the art and as the invention is entirely concerned with a method and apparatus for forming a continuous chain of stitches between pieces of material, it is only considered necessary here to illustrate and describe those parts which are directly concerned with a preferred form of the present invention.

Referring now to FIG. 1 the sewing machine is provided with a pair of needles 1 and 2 disposed in operative association with the machine's presser foot generally indicated by numeral 3 and the machine's needle plate that is identified by numeral 4.

A single looper 5 is located below the needle plate 4 and serves to cooperate with the needles 1 and 2 in a well known manner.

The needle plate 4 is provided with the usual rectangular openings 6 through which the rows of teeth 7 of a conventional feed dog are caused to intermittently protrude in timed sequence with the stitching cycle. Additionally the needle plate 4 is provided with a pair of centrally located openings 8 and 9 which provide a means for the needles to pass therethrough during the formation of each stitch of a seam.

These openings 8 and 9 are elongated (FIG. 1) and extend in a direction of the indicating arrow "A" which is the same direction that the material is caused to travel during the sewing operation. A transverse opening 10 interconnects those ends of openings 8 and 9 most remote from the needles and serves as a means for releasing the stitches formed beneath that portion of the needle plate intermediate said openings 8 and 9 which defines a tongue 11. The width of the transverse opening 10 is limited by an element forming an integral part of the needle plate 4 which defines a cross member 12 having a function that will be more fully described hereinafter.

The presser foot 3 includes a support 13 for attaching it to a conventional pressure device (not shown) and a main flange 14 that is hinged to said support 13 and which includes an opening 15 through which the needles 1 and 2 are adapted to pass during the seaming cycle.

The presser foot 3 includes an auxilliary feed member that is formed by a flange member 16 fixed on the lower end of a vertically extending rod 17 which is slidably assembled in the support 13. A helical spring 18 is assembled on the rod 17 and serves to continually urge the flange member 16 downwardly toward the cross member and feed dog and through an opening 19 of conforming configuration provided in the main flange 14. The width of the flange member 16 is greater than the distance between the needles and must be at least equal to the length of the cross member 12 so as to provide positive engagement with the chain regardless of its location on said cross member.

This auxiliary feed member is adapted to function in cooperation with the central row of teeth of the feed dog to effect forward movement of the chain of stitches 20 as it comes upwardly through the transverse opening 10. Additionally the auxiliary feed member cooperates with the cross member 12 so as to hold the chain of stitches in a fixed position as the feed dog travels below the upper surface of the needle plate 4.

To facilitate guiding the chain of stitches 20 for engagement by the central row of teeth of the feed dog, the cross member 12 is provided with a centrally disposed channel or groove 12*a* which communicates with the transverse opening 10 and serves as a means that centralizes the chain as well as providing freedom of movement onto said cross member 12.

Each of the needles 1 and 2 and the looper 5 have a thread operatively associated therewith which are identified by numerals 21, 22 and 23 respectively. Each thread is subject to a tensioning action provided by a conventional tension device 24. In FIG. 1 the tension device for controlling tension of thread 21 is shown at 24 and the one for thread 22 at 24' which includes a pair of opposed disks 26'.

This tension device 24 is provided with a sleeve 25 that supports a pair of disks 26 which, in a known manner, are spring biased one toward the other and include adjustment means for increasing or decreasing this biasing force. The thread 21 extends between these disks so as to be suitably tensioned thereby.

A rod 27 is slidably supported within the sleeve 25 and by a means yet to be described is adapted to exert an axial force to separate the disks 26 and release the tension on the thread 21.

A chain cutter 28 is located adjacent to the needle plate 4 and includes an opening 29 into which the chains are drawn and cut that extend from either the rear edge of the sewn material or from the needle plate.

The machine is provided with a sensing device for detecting the presence of the material being sewn. This sensing device forms a part of a conventional electrical control unit 40 which includes an electromagnet 32', a source of light defining a lamp element 30 and a photoelectric cell 31 which are disposed adjacent the thread cutter 28 so as to be activated and effect actuation of said electro-magnet when a sewn piece of material is caused to be advanced beyond the sewing area. This electro-magnet 32 is operatively connected to a means for releasing the tension on the thread 21. This means defines a wedge member 32 that is supported for sliding movement in a vertical direction and is disposed so as to be in contact with one end of the rod 27 to effect longitudinal movement of the latter upon actuation of the electro-magnet 32'.

Figure 3:
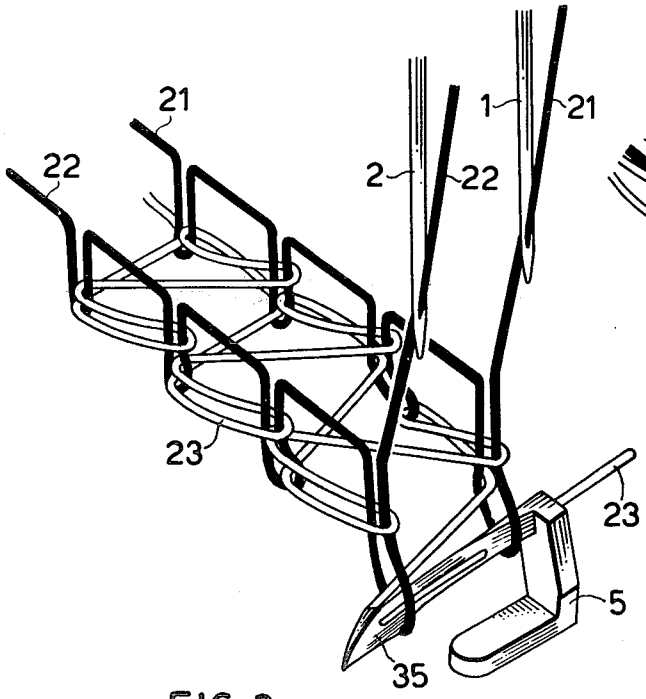
FIG. 3 is a perspective view of an enlarged scale showing the formation of the stitches during normal operation of the sewing machine.

Since the stitches are firmly attached to the material during the sewing of a conventional seam, the tension on the individual threads 21, 22 and 23 is evenly distributed by the resistance of the material itself, and the threads are disposed or arranged in the manner shown in FIG. 3.

At the completion of each stitching cycle, the sewn material is caused to be advanced beyond the sewing area which exposes the photoelectric cell 31 to the source of light from the lamp 30.

Figure 4:
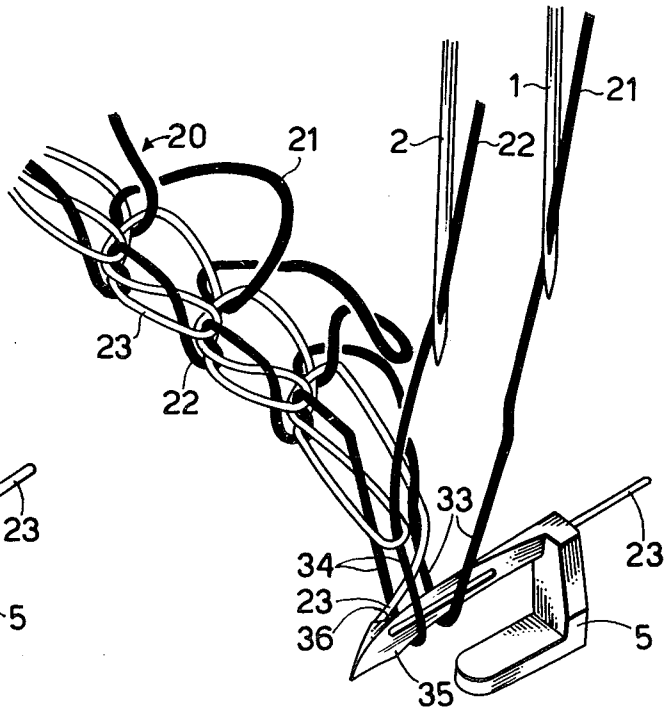
FIG. 4 is a view similar to FIG. 3 but showing the formation of a single chain of stitches in accordance with the method and apparatus of the invention.

The activation of the photoelectric cell causes the wedge 32 to move downwardly causing longitudinal movement of rod 27 which is effective in separating the disks 26 so as to release the tension on the thread 21. By this method, the thread 21 of the needle 1 no longer offers resistance to being drawn towards the thread 22 of the needle 2 by the thread 23 of the looper 5 as is shown in FIG. 4.

The tight linking of the two needle threads causes a different placement of the relative slip-knots 33 and 34 that are looped around the blade 35 of the looper 5.

Consequently, only the needle 2 succeeds in penetrating the "triangle" 36 formed by the thread 23 as it leaves the looper 5, the blade 35 of the looper and the slip-knot 34 of the thread 33 thereby causing the desired linking of these threads. The needle 1 and its thread 21, during their vertical movement fail to cooperate with the looper thread 23 to form stitches after the tension has been released on said thread 21.

The chain that is formed by threads 2 and 23 is formed in the area of the left portion of the needle plate and is acted upon in a positive manner by the combined action of auxiliary feed member carried by the presser foot, the cross member 12 and the rows of teeth 7 of the feed dog.

It is preferable to release the tension on the thread of the right hand needle 1 so as to increase the traction action of the thread of the looper for the thread of said needle 1 is further loosened on the slip-knot 33 due to the leftward movement of said looper during the slip-knot grasping phase. This release of tension of the thread of needle 1 facilitates the sliding of the slip-knot 33 towards the slip-knot 34 of the thread of the left hand needle 2.

Obviously the tension on the thread of the left needle may be released so as to cause the chain of stitches to be formed with the right needle, but the immediateness or results shows it is more desirable that this function be performed in the manner described above.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A device for forming a continuous chain of stitches between pieces of material on a sewing machine of the type having a feed dog and pressor foot with two needles drawing their thread from independent sources through separate tensioning devices and a needle plate forming a portion of the machine's sewing area with a single looper having an independent thread source disposed beneath the needle plate, said device comprising:

(a) means mounted on the sewing machine for releasing the tension on the thread of one of the needles;

(b) means operatively connected to said releasing means for sensing the presence of material in the sewing area and for actuating said releasing means upon detection of the absence of material in the sewing area, including:

(i) a source of light defining a lamp (30); and (ii) a photo-electric cell (31) spaced from and in alignment with said lamp (30) adjacent the sewing area of the machine;

(c) a cross member forming an integral part of the needle plate for receiving the chain of stitches formed by the tensioned threads of the other needle and looper; and (d) an auxiliary feed member mounted in the presser foot in operative association with the feed dog and said cross member for advancing the chain of stitches formed by the tensioned needle and looper threads.

* * * * *